US008104706B2

(12) United States Patent
Aas et al.

(10) Patent No.: US 8,104,706 B2
(45) **Date of Patent: *Jan. 31, 2012**

(54) NOTE TRANSPORT UNIT

(75) Inventors: Per Christian Aas, Olso (NO); John-Haakon Lippert, Klokkarstua (NO); Anders Ekberg, Löddeköpinge (SE)

(73) Assignee: Scan Coin AB, Malmo (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/695,356

(22) Filed: Jan. 28, 2010

(65) Prior Publication Data

US 2010/0164163 A1 Jul. 1, 2010

Related U.S. Application Data

(63) Continuation of application No. PCT/SE2008/050872, filed on Jul. 15, 2008.

(60) Provisional application No. 60/955,090, filed on Aug. 10, 2007.

(51) Int. Cl.
*B65H 39/14* (2006.01)

(52) U.S. Cl. ..... 242/528; 271/213

(58) Field of Classification Search ..... 242/528; 271/18, 213

See application file for complete search history.

(56) References Cited

U.S. PATENT DOCUMENTS

| | | | | |
|---|---|---|---|---|
| 4,337,864 | A * | 7/1982 | McLean | 209/534 |
| 5,313,050 | A | 5/1994 | Hiroki et al. | |
| 5,735,516 | A * | 4/1998 | Gerlier et al. | 270/60 |
| 5,804,804 | A | 9/1998 | Fukatsu et al. | |
| 6,367,692 | B1 | 4/2002 | Junkins et al. | |
| 6,568,673 | B2 * | 5/2003 | Mochizuki et al. | 271/213 |
| 7,490,823 | B2 * | 2/2009 | Oishi et al. | 271/3.01 |
| 2002/0096818 | A1 | 7/2002 | Mochizuki et al. | |
| 2010/0168903 | A1 * | 7/2010 | Aas et al. | 700/214 |

FOREIGN PATENT DOCUMENTS

| | | | |
|---|---|---|---|
| EP | 0 493 127 | A2 | 7/1992 |
| EP | 1 598 786 | A2 | 11/2005 |
| GB | 2 071 059 | A | 9/1981 |
| WO | WO 2004/013819 | | 2/2004 |
| WO | WO 2007/037744 | A1 | 4/2007 |
| WO | WO 2007/037745 | A1 | 4/2007 |

* cited by examiner

*Primary Examiner* — Sang Kim
(74) *Attorney, Agent, or Firm* — Womble Carlyle Sandridge & Rice, LLP

(57) ABSTRACT

It is presented a note transport unit for feeding notes one after the other to and from a note handling unit. The note transport unit comprises at least one note storage drum to and from which input notes and output notes, respectively, are transported. A bidirectional roller is arranged to transport notes along a first guide surface towards and from the at least one note storage drum. Moreover, first and second films are provided, between which films notes are stored on the at least one note storage drum. Several converging areas are used for the capturing of both input notes and output notes when notes are transferred between the note handling unit and the at least one note storage drum. It is also presented a method for bidirectional transfer of notes to and from the note transport unit.

13 Claims, 9 Drawing Sheets

NOTE TRANSPORT UNIT

CROSS-REFERENCE TO RELATED APPLICATIONS

This application is a continuation application of prior PCT application No. PCT/SE2008/050872, filed Jul. 15, 2008 and designating the United States, entitled "Note Transport Unit" which PCT application claims the benefit of U.S. Provisional Application No. 60/955,090, filed on Aug. 10, 2007, and Swedish Patent Application No. 0701845-0, filed Aug. 10, 2007.

INCORPORATION BY REFERENCE

The entire disclosures of PCT Application No. PCT/SE2008/050872, filed Jul. 15, 2008; U.S. Provisional Application No. 60/955,090, filed Aug. 10, 2007; and Swedish Patent Application No. 0701845-0, filed Aug. 10, 2007, are incorporated herein by reference as if set forth in their entireties.

TECHNICAL FIELD

The present inventive concept relates to the transfer of notes between a note transport unit and a note handling unit.

More specifically, the present inventive concept relates to a note transport unit and a method for guiding notes to and from the note transport unit.

TECHNICAL BACKGROUND

It is known to utilize a note transport unit for temporary connection with a stationary note handling unit in order to transport notes in a safer way, without human interaction with the notes during the transfer. In prior-art transport units, the notes are transferred in stacks between the stationary note handling unit and the note transport unit.

SUMMARY

A general object is to provide enhanced control of input notes and output notes in a note transport unit during the transfer of notes to and from the transport unit.

According to a first aspect of the present inventive concept, there is provided a note transport unit for feeding notes one after the other to and from a note handling unit, the note transport unit having an infeed direction for input notes and an outfeed direction for output notes, wherein the note transport unit comprises at least one note storage drum on which the input notes are stored by being spooled around the drum between first and second films and from which the output notes are being spooled of, the first and second films presenting a lower and an upper film portion, respectively, which film portions converge towards each other in the infeed direction, a first note guide surface for guiding the input notes from the note handling unit towards the converging film portions and for guiding the output notes towards the note handling unit, a bidirectional roller arranged to transport the input notes and the output notes along the first note guide surface, and a second note guide surface which is arranged between the first note guide surface and the lower film portion and which is intersected by a plane defined by the lower film portion.

An effect which may be obtainable by the transport unit according to the inventive concept is a controlled bidirectional transfer of notes to and from the note transport unit.

The second guide surface may be intersected by the plane with an obtuse angle. Thereby, output notes may be effectively directed further in the outfeed direction. Especially, this design may reduce the risk of jamming of notes between the lower film portion and the second guide surface.

The second guide surface may be inclined downwardly relative to the first guide surface in the infeed direction. Because the second guide surface usually may not need to be active in the note infeed direction, input notes can thereby pass above the second guide surface towards the area where the further path of the input notes can be effectively controlled by the converging upper and lower film portions. Especially, one may thereby reduce the risk of output notes being jammed in transitional area between the lower film portion and the second guide surface.

The second guide surface and the bidirectional roller may be so located in relation to each other that output notes guided along the second guide surface in the outfeed direction are directed towards the roller. An effect which may be obtainable thereby is that the roller may guide an output note towards the first guide surface and thereafter, as a moving component rotating in an outfeed direction, transport the output note further in the outfeed direction along the first guide surface.

The first guide surface may be the first surface of the transport unit which receives input notes from the note handling unit and may be inclined upwardly in the infeed direction. An effect which may be obtainable thereby is that an input/output part of a note handling unit can enter into the note transport unit for safer note transportation and more robust connection between the note handling unit and the note transport unit. This may also enable connection of the note transport unit to a note handling unit which has a singe note infeed/outfeed opening and/or a uni-directional main transport belt.

The first guide surface may be provided with a protruding portion for bending the notes perpendicularly to the transport direction of the notes when transported along the first guide surface. The stiffness thereby obtained may result in a more controlled note path.

In a preferred embodiment, the first guide surface and the second guide surface may form a continuous guide surface. An effect which may be obtainable thereby is to avoid notes being jammed in any gap or similar between the first guide surface and the second guide surface in neither the note infeed direction nor the note outfeed direction.

According to a second aspect of the present inventive concept, there is provided a method in a note transport unit for bidirectional transfer of notes one after the other between the note transport unit and a note handling unit, the transport unit having a note infeed direction for input notes and a note outfeed direction for output notes, the method comprising:

a) when handling an input note:

receiving at a first guide surface of the transport unit the input note from the note handling unit;

transporting the input note along the first guide surface by means of a bidirectional roller rotating in an first direction;

receiving the input note in a first converging area which is formed between upper and lower film portions and which converges in the note infeed direction, the upper and lower film portions forming part of first and second films, respectively, and storing the input note on a note storage drum between said first and second films; and b) when subsequently handling the input note as an output note:

dispensing the output note from note storage drum;

passing the note through the first converging area and into a second converging area which is formed between the bidirectional roller and a second guide surface and which converges in the note outfeed direction; and guiding the note towards the first guide surface by the bidirectional roller rotating in a second direction.

Additional possible features and preferred embodiments are set out in the dependent claims and disclosed in the following.

BRIEF DESCRIPTION OF THE DRAWINGS

The inventive concept and further advantages will now be described by way of a non-limiting embodiment, with reference to the accompanying drawings.

DESCRIPTION OF EMBODIMENTS OF THE INVENTIVE CONCEPT

Figure 1:
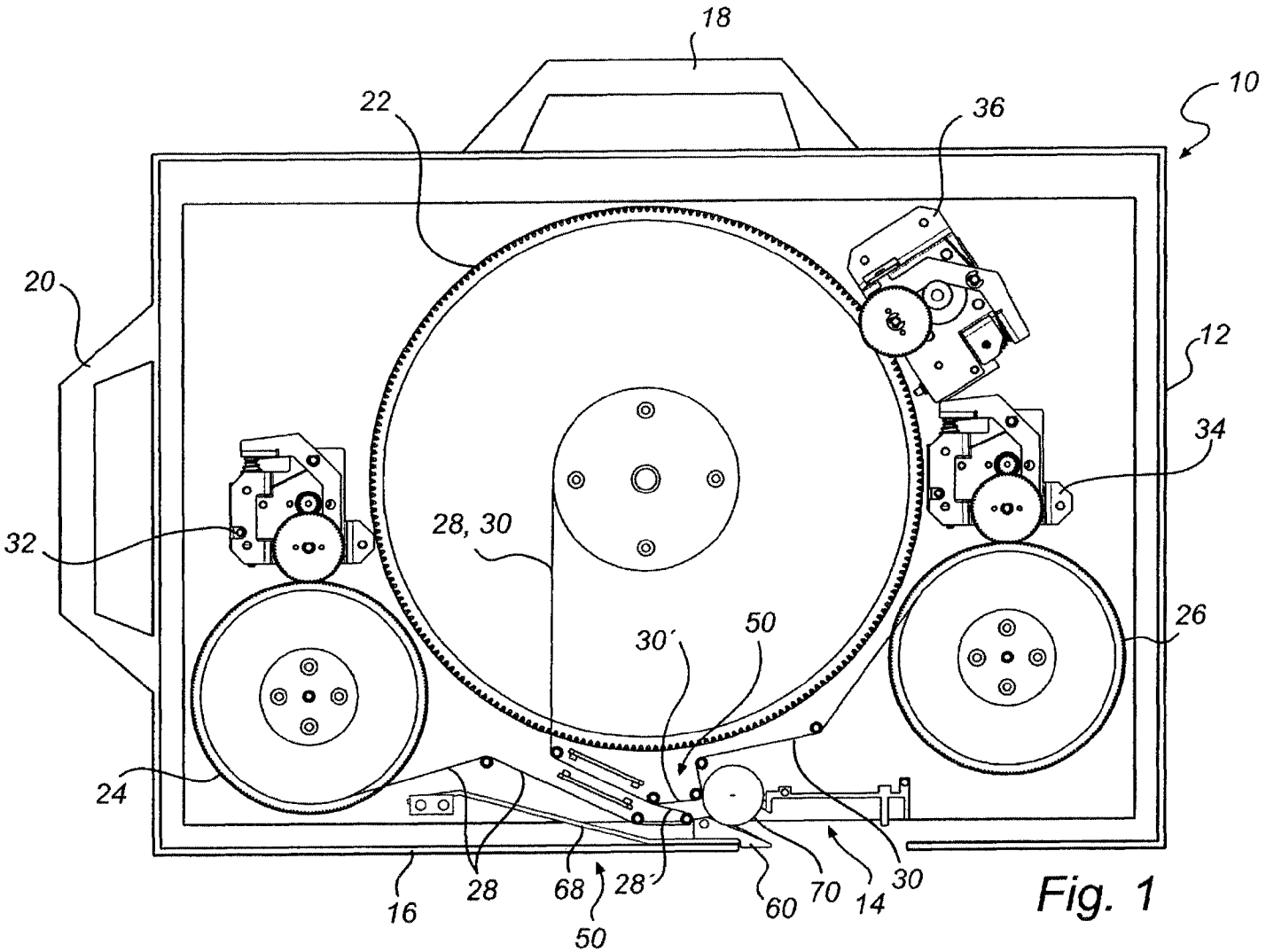
FIG. 1 is a cross sectional view of an embodiment of a note transport unit in accordance with the inventive concept.

FIG. 1 is a cross sectional view of an embodiment of a portable note transport unit 10 in accordance with the inventive concept. The note transport unit 10 may be used for transporting notes to and from one or more note handling units (see unit 100 in FIG. 2), e.g. in a system comprising a plurality of stationary note handling units. In use, the note transport unit 10 may be temporarily connected to a note handling unit to transfer notes of one or more denominations one after the other in a direction out from the transport unit 10 and into the note handling unit. Notes being fed out from the note transport unit 10 will be referred to as output notes in the following.

The note transport unit 10 may also be temporarily connected to a note handling unit for transferring notes of one or more denominations one after the other in the opposite direction from the note handling unit and into the note transport unit 10. Notes being feed into the note transport unit 10 will be referred to as input notes in the following.

The note transport unit 10 comprises an outer casing 12 having a note infeed/outfeed opening 14 in its bottom part 16 and being provided with exterior handles 18, 20 for carrying the note transport unit 10 and to facilitate placement of the note transport unit 10 on note handling units. Inside the casing 12, the transport unit 10 comprises a note storage drum 22, first and second film drums 24, 26, first and second films 28, 30, first and second film drum motors 32, 34 for driving the film drums 24, 26, a storage drum motor 36 for driving the note storage drum 12, and a bidirectional note guiding and feeding mechanism, indicated by general reference numeral 50 and arranged adjacent to the infeed/outfeed opening 14. This mechanism will be referred to as the infeed/outfeed mechanism 50, and the structure and operation thereof will be described in detail in the following.

The motors 32, 34 and 36 are operated simultaneously in either a note infeed direction or in a note outfeed direction. In the infeed direction, the films 28, 30 are spooled off from the film drums 24, 26 and spooled together on to the storage drum 22 with input notes being held between the films 28, 30. In the outfeed direction, the films 28, 30 are spooled off from the note storage drum 22 and back on the film drums 24, 26, whereby the notes may be fed out from the transport unit 10 as output notes.

Figure 2:
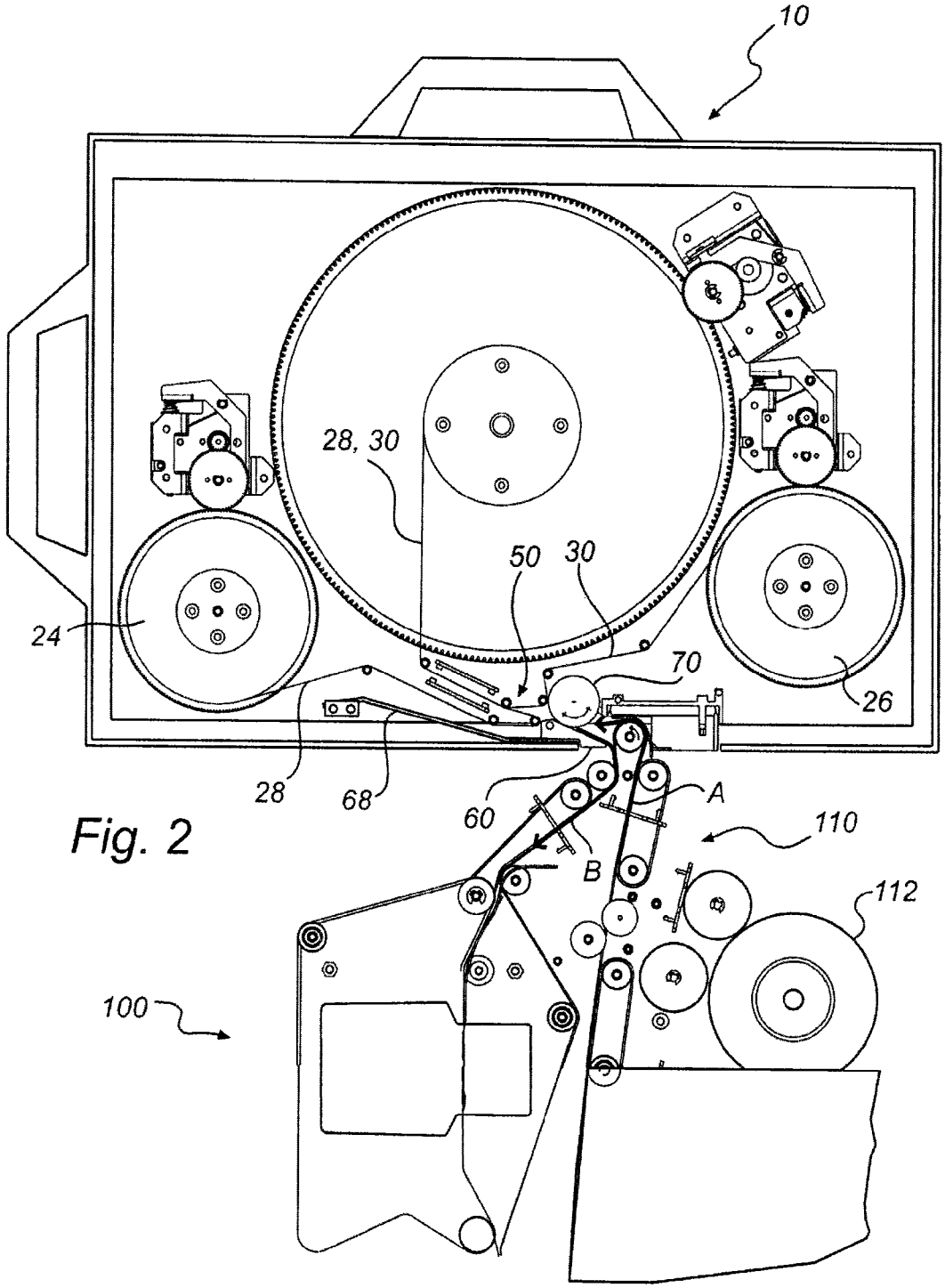
FIG. 2 illustrates the note transport unit in FIG. 1 connected to a note handling unit for note transfer therebetween.

FIG. 2 is a cross sectional view of a note transport unit 10 connected to a note handling unit 100 of which only an upper portion is shown. The note handling unit 100 comprises a system of transport belts 110, and at least one note storage drum 112. When an output note is received by the note handling unit 100 from the note transport unit 10, it is transported by the system of transport belts 110 and can eventually be directed into the suitable note storage drum 112. The note can subsequently be dispensed from the note storage drum 112 and be fed into the note transport unit 10 as an input note. The interaction between the note transport unit 10 and the note handling unit 100 allows notes to be recycled without human contact. The note transport unit 10 enables bidirectional transportation of notes one after the other, as schematically indicated by bold arrows A and B in FIG. 2.

In the illustrated embodiment, the transport unit 10 presents above the opening 14 an area where a part of the note handling unit 100 may protrude, as illustrated in FIG. 2. A downwardly protruding element 80 (see FIG. 3) of transport unit 10 and a matching groove in the note handling unit allows the two units to be properly aligned.

Figure 3:
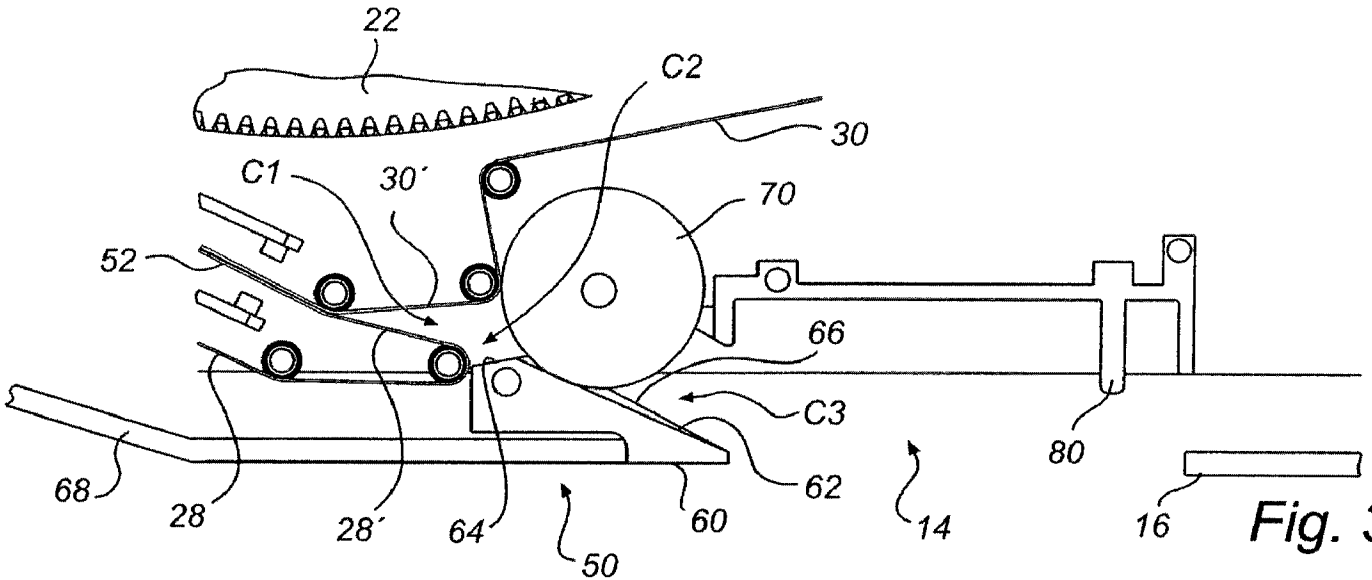
FIG. 3 is an enlarged view of a note guiding and feeding mechanism of the note transport unit in FIG. 1.
Figure 4:
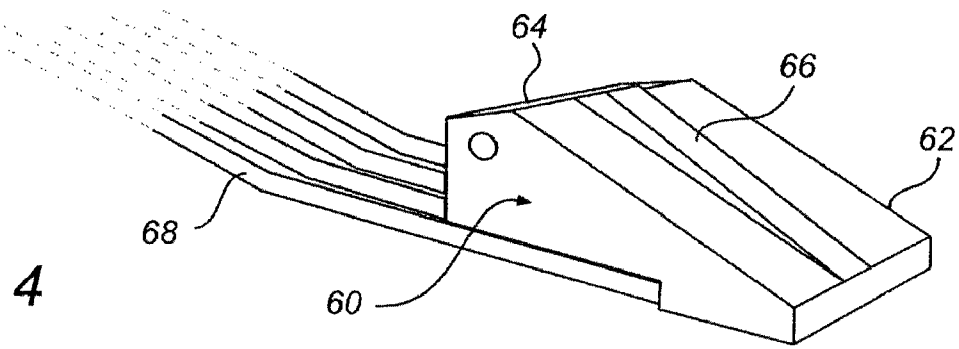
FIG. 4 is a perspective view of a ramp body forming part of the mechanism in FIG. 3.
Figure 6:
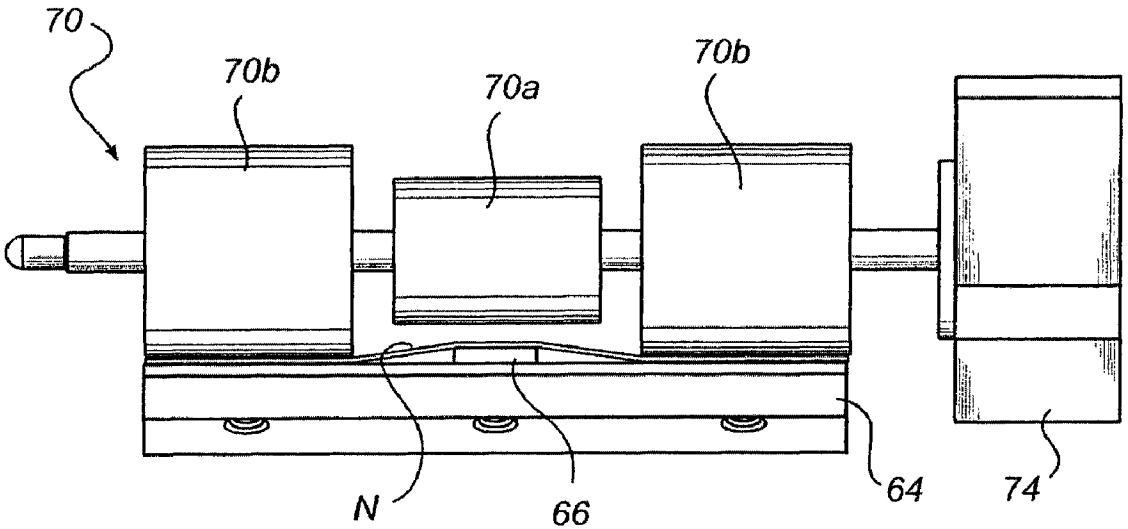
FIG. 6 is view as seen in a note outfeed direction of the mechanism in FIG. 5.
Figure 5:
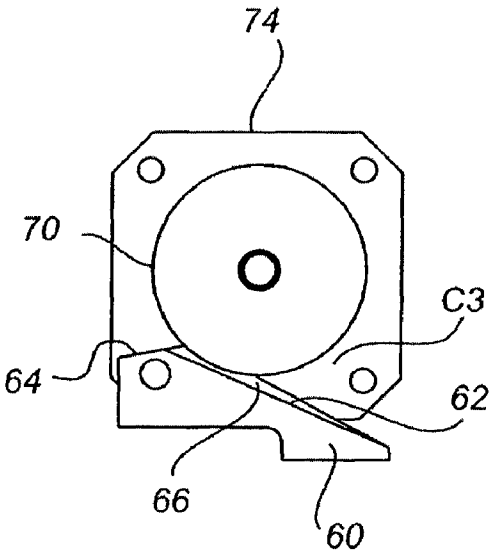
FIG. 5 is a side view of parts of the mechanism in FIG. 3.

FIG. 3 is an enlarged view of the infeed/outfeed mechanism 50, and details of the mechanism 50 are illustrated in larger scale in FIGS. 4 to 6.

In this embodiment, the infeed/outfeed mechanism 50 is located at the bottom part of the casing 12 adjacent the infeed/outfeed opening 14. In the infeed direction, the infeed/outfeed mechanism 50 serves to receive input notes from the note handling unit 100 via the infeed/outfeed opening 14 and to guide and feed these input notes further in the infeed direction towards a location 52 in the transport unit 10 where the input notes are being caught by the moving films 28, 30, in order to be spooled upon the note storage drum 22.

In the outfeed direction, the infeed/outfeed mechanism 50 serves to receive output notes from the films 28, 30 being spooled off from the note storage drum 22 and to guide and feed these output notes further towards and out through the opening 14 of the transport unit 10.

From a note guiding perspective, the note infeed/outfeed mechanism 50 comprises a first converging area C1 which converges in the note infeed direction, a second converging area C2 which converges in the note outfeed direction, and a third converging area C3 which converges in the note infeed direction.

The first converging area C1 is formed between a lower film portion 28' forming part of the first film 28 and an upper film portion 30' forming part of the second film 30. In the infeed direction, the lower and upper film portions 28', 30' converges towards an area 52 (FIG. 3) where the films 28, 30 run together for holding notes therebetween.

In the embodiment illustrated, the infeed/outfeed mechanism 50 is formed by said converging film portions 28', 30', a ramp body 60 and a bidirectional guide and feed roller 70. The ramp body 60 has an upper first guide surface 62 which leads to/from the infeed/outfeed opening 14 and which normally would be the first surface infeed notes contact when they are received from the note handling unit 100. The first guide surface is inclined upward in the infeed direction. The ramp body 60 further has an upper second guide surface 64. The second guide surface 64 forms a continuous extension (no gap) of the first guide surface 62 and is in this embodiment shorter than the first guide surface 62. The second guide surface 64 is inclined downward in relation to the first guide surface 62. The ramp body 60 is supported by a spring mechanism 68 connected to the inner part of the transport unit 10.

In this embodiment, the feed roller 70 is positioned with its rotational axis 72 above the first guide surface 62 such that part of the roller extends in the infeed direction over the second guide surface 64. The roller 70 may be manufactured of e.g. foam material for good friction with notes. A separate motor 74 (FIGS. 5 and 6) is arranged to drive the roller 70 in either the infeed direction or the outfeed direction. The second converging area C2 is formed between the second guide surface 64 and a part of the roller 70. The third converging area C3 is formed between the first guide surface 62 and a part of the roller 70.

An effect of the first guide surface 62 being inclined upwardly in the note infeed direction is that the note guiding components of the infeed/outfeed mechanism 50 may be placed vertically higher in the note transport unit 10 so that the system of transport belts 110 of the note handling unit 100 can penetrate into the note transport unit 10 via the opening 14 during note transfer, as mentioned above. This enables the note handling unit 100 to use a uni-directional main belt and to have the same note input/output opening handling both output notes being fed into the note handling unit 100 and input notes being fed from the note handling unit 100 to the transport unit 10.

In the illustrated embodiment, in order to obtain an increased path control during note feeding, notes are being bent in a direction transverse to their transport direction when being transported by roller 70 along the first guide surface 70.

To this end the ramp body 60 (FIG. 3) is provided with a protruding portion 66 along the center of the first guide surface 62. The protruding portion 66 increases in height gradually relative the first guide surface 62 in the infeed direction. This way, an input note can be guided more smoothly when the input note first contacts the first guide surface 62. Also, an output note is smoothly transferred from the second guide surface 64 to the first guide surface 62.

As shown in FIG. 6 the roller 70 may comprise a central roller 70*a* having a first diameter and two lateral rollers 70*b* having a second larger diameter. In FIG. 6, a note N transported along the first guide surface 62 is being bent as shown as a result of the combined effect of the protruding portion 66 and the rollers 70*a* and 70*b* of different diameters.

When an input note enters the note transport unit 10, it will pass through the converging areas C3, C2 and C1 in named order. However, area C2 would normally not have any guiding effect in the infeed direction since it is diverging in the infeed direction.

The input notes coming in through the opening 14 will enter the third converging area C3 and may be guided by the first guide surface 62 and/or the surface of the rotating roller 70. Initially, the input note may be transported by means of the note handling unit 100 until it reaches the roller 70 rotating in the note infeed direction. The roller 70 may then continue the transportation of the input note along the first guide surface 62.

The input note will then enter and pass through the second area C2. Thereafter, the input note enters the first converging area C1. The input note may be effectively captured in the first converging area C1 and guided in between the first and second films 28, 30.

When guiding the input note into the first converging area C1, transportation of the input note may initially be performed by the roller 70. When the input note has been caught between the first and second films 28, 30 further, transportation of the input note is possible by the films only. The input note can thereafter be stored on the note storage drum 22 between the films 28, 30.

When subsequently an output note (previously an input note) is dispensed from the note storage drum 12, the output note will be transported between the first and second films 28, 30 until it enters the first converging area C1 (now diverging in the note outfeed direction). When a leading part of the output note has entered the first converging area C1, a trailing part of the output note can still be transported in the note outfeed direction between the films. The second converging area C2 may then catch the output note in order to guide it further through the mechanism 50 towards the opening 14.

Due to initial bending, age, damage, etc of the input and output notes, the notes may follow different paths through the mechanism 50. However, due to the combined effect of the converting areas C1-C3 and the guide surfaces, all input and output notes will be effectively guided through the mechanism 50 without being caught in gaps or by rollers. Some different possible note paths will now be described with reference to FIGS. 7*a*, 7*b*, 8*a* and 8*b*.

Figure 7A:
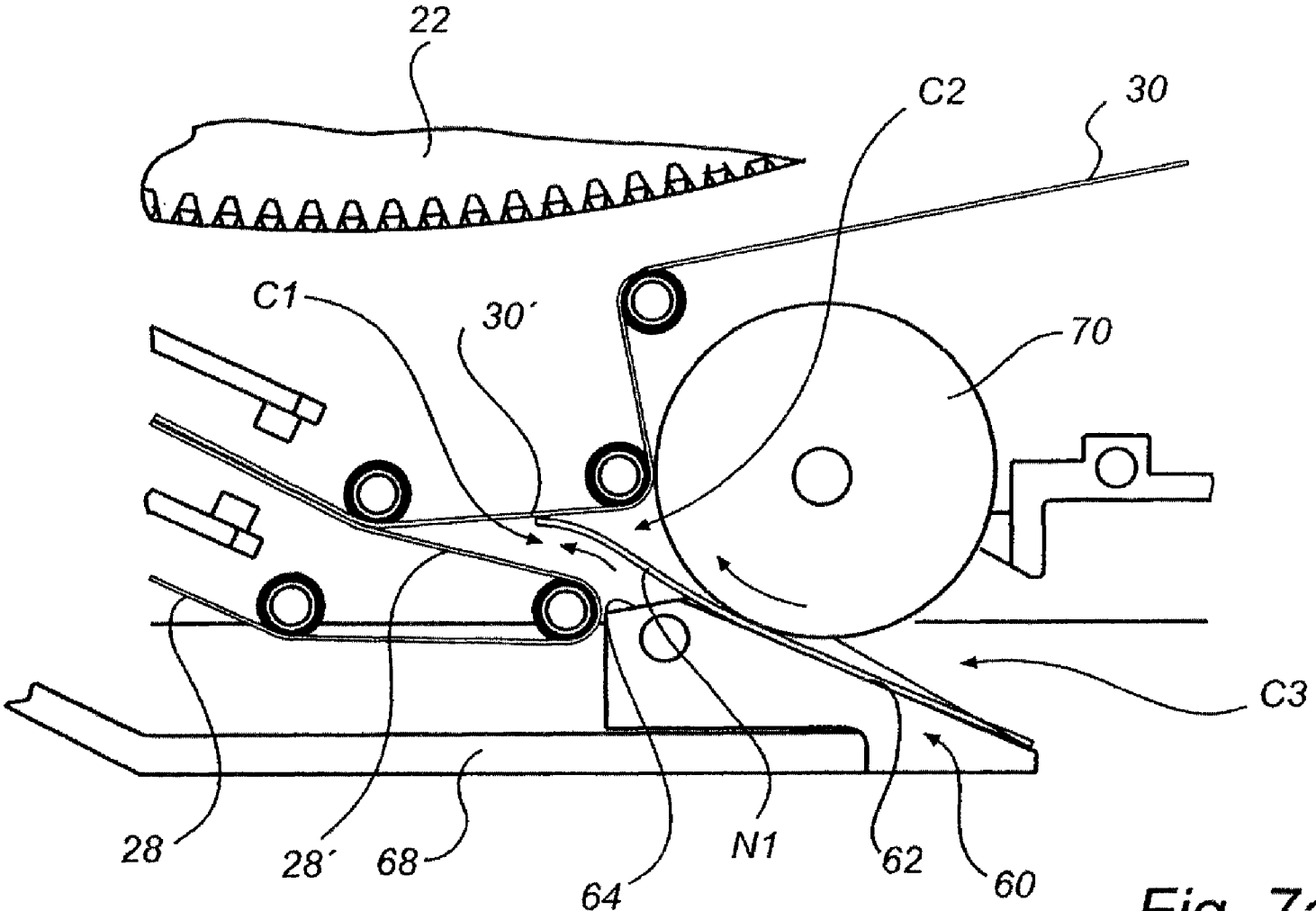
FIGS. 7*a* and 7*b* are schematic illustrations of two examples of input note paths in the transport unit in FIG. 1.

FIG. 7*a* is a schematic illustration of a first possible guide path of a input note N1 received by the transport unit in FIG. 1. As the input note N1 enters the note transport unit 10, it is captured in the third converging area C3 and transported along the first guide surface 62 by means of the roller 70 rotating in the infeed direction. The input note N1 is bent perpendicularly to the note infeed direction by the protruding portion 66 for better control of the input note N1. The input note N1 will then enter the second converging area C2. When a trailing part of the note N1 is still at the first guide surface 62 and thereby maintained in a bent condition the leading part of the note being located in the intermediate second converging area C2 will also be bent and, thereby, more effectively controlled towards the first converging area C1 formed by film portions 28', 30'.

In the example shown in FIG. 7*a*, the leading edge of the input note N1 hits the upper film portion 30'. The upper (moving) film portion 30' will thereby act as a combined guiding and transporting element, guiding the input note N1 through the first converging area C1 in the infeed direction. This transport may involve contact also with the lower film portion 28'. Transportation of the input note N1 through the converging areas C2 and C1 may be aided by the roller 70 rotating in the infeed direction. The input note N1 is then caught between the first and second films 28, 30 and subsequently transported to the note storage drum 22.

Figure 7B:
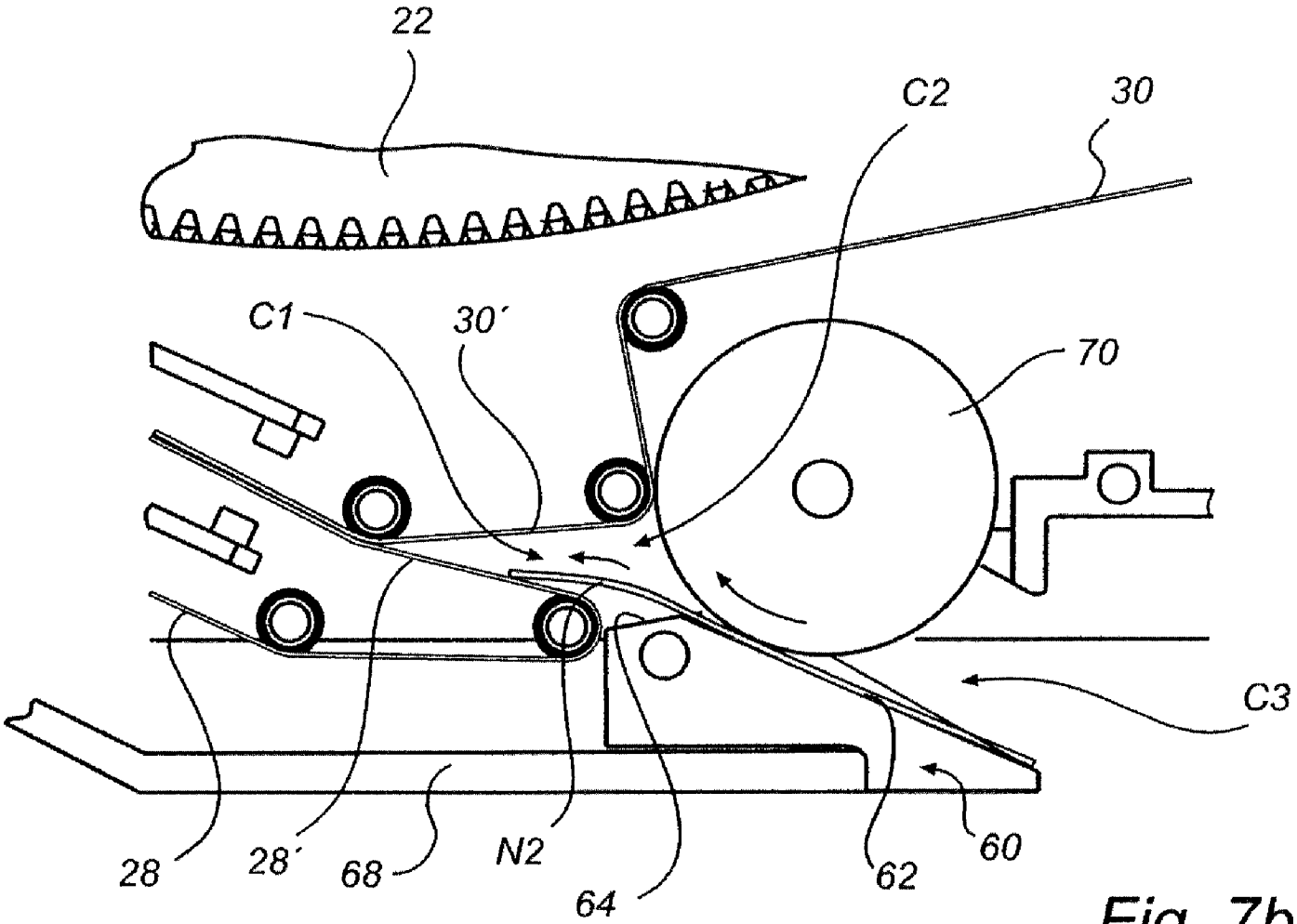

FIG. 7*b* is a schematic illustration of a second possible guide path of an input note N2 received by the note transport unit 10 in FIG. 1. In this example, the leading edge of the input note N2 will instead hit and/or follow the lower film portion 28'. The lower (moving) film portion 28' will thereby act as a combined guiding and transporting element, guiding the input note N2 through the first converging area C1. This transport may involve contact also with the upper film portion 30'.

As illustrated by the two infeed examples in FIGS. 7*a* and 7*b*, the intermediate, second converging area C2 (which is formed by the second guide surface 64 and part of the roller 70) will normally not be active in note guiding during note infeed. Input notes are normally passed over the second guide surface 64 and, thereby, over the interface (gap) between the second guide surface 64 and the lower film portion 28', reducing the risk of being caught in the mechanism 50.

Figure 8A:
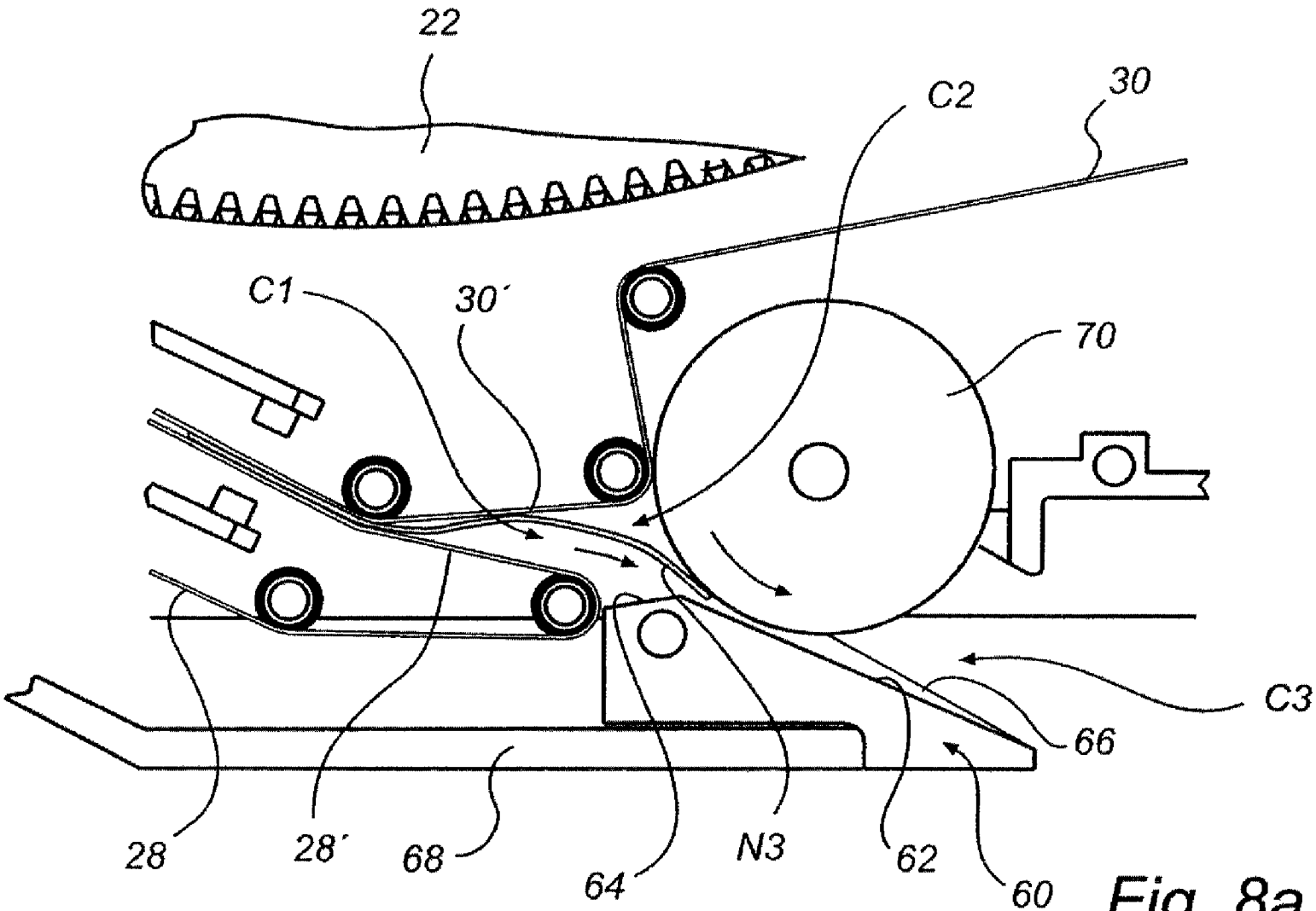
FIGS. 8*a* and 8*b* are schematic illustrations of two examples of output note paths in the transport unit in FIG. 1.

FIG. 8*a* is a schematic illustration of a first possible outfeed guide path of an output note N3 to be dispensed from the note transport unit 10 in FIG. 1. As the output note N3 leaves the area 56 between the films 28, 30 it enters the first converging area C1 (now diverging in the outfeed direction). FIG. 8*a* illustrates an extreme case where the output note N3 (e.g. due to initial note bending) is guided by the upper film portion 30' when entering the first converging area C1. The output note N3 will leave area C1 and enter the second converging area C2. Due to the fact that the second or intermediate area C2 is converging in the outfeed direction, it may effectively guide output notes further through the mechanism 50.

In this example, when the leading edge of the output note N3 reaches the roller 70 rotating in the outfeed direction, the output note N3 is deflected downward towards the first guide surface 62 of ramp body 60. In some instances, the deflection may involve the roller 70 directing the output note N3 towards the second guide surface 64 also. The second guide surface 64 may then re-direct the output note N3 towards the first guide surface 62. Thereafter, the roller 70 will transport the output note N3 in the outfeed direction to and out through the infeed/outfeed opening 14 of the note transport unit 10.

Figure 8B:
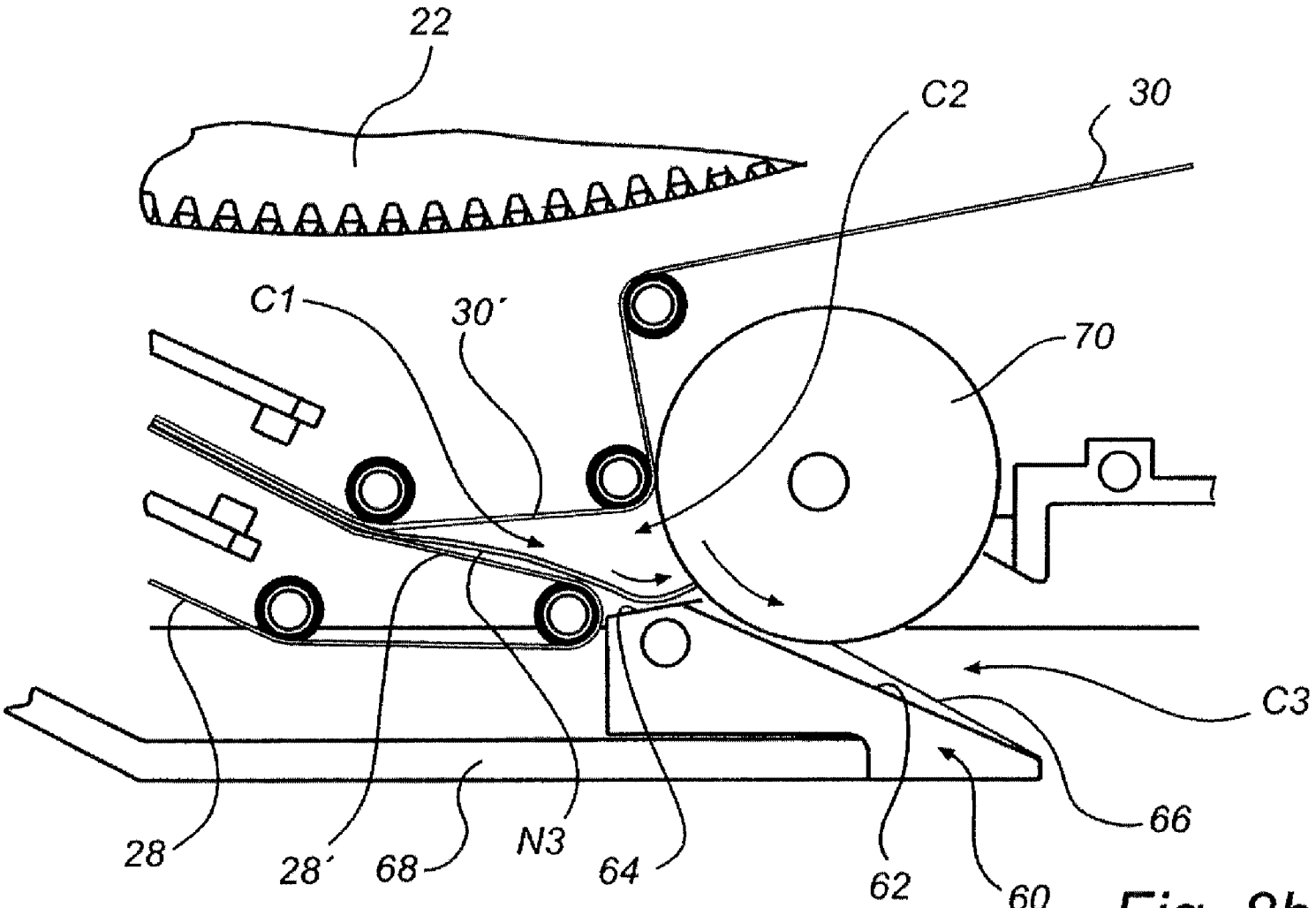

FIG. 8*b* is a schematic illustration of a second possible guide path of an output note N4. In this example the output note N4 is instead is guided along the lower film portion 28' when entering the first converging area C1. The second guide surface 64 is intercepted by a plane (not shown) defined by the lower film portion 28'. As a result thereof, the output note N4 being guided and transported along the lower film portion 28' in FIG. 8*b* will be guided towards, and hit the second guide surface 64. The second guide surface 64 thereby deflects (typically less than 90 degrees) the output note N4. The note N4 is transported and guided towards the roller 70 as illustrated and thereby further guided along the first guide surface 62. It should be noted that the design is such that it minimizes the risk that the leading edge of the output note N4 is being caught in the gap between the lower film portion 28' and the second guide surface 64.

In any other situation between the "extreme" situations illustrated in FIGS. 8*a* and 8*b*, one or both of the second guide surface 64 and the roller 70 (forming the converging area C2) may effectively assist in guiding the output notes in the note outfeed direction.

To summarize, in the note infeed direction the third converging area C3 and the first converging area C1 are active guiding input notes (N1, N2), whereas in the note outfeed direction, the second converging area C2 is active in capturing and guiding output notes (N3, N4). Thus, in the note infeed direction, there are two active converging and guiding areas (C1, C3) for capturing/guiding input notes, whereas in the note outfeed direction there is one active converging area (C2). These interchangeable converging and diverging areas C1, C2, C3 provide an effective means for transporting notes in both direction at the interface with the not handling unit.

Figure 9:
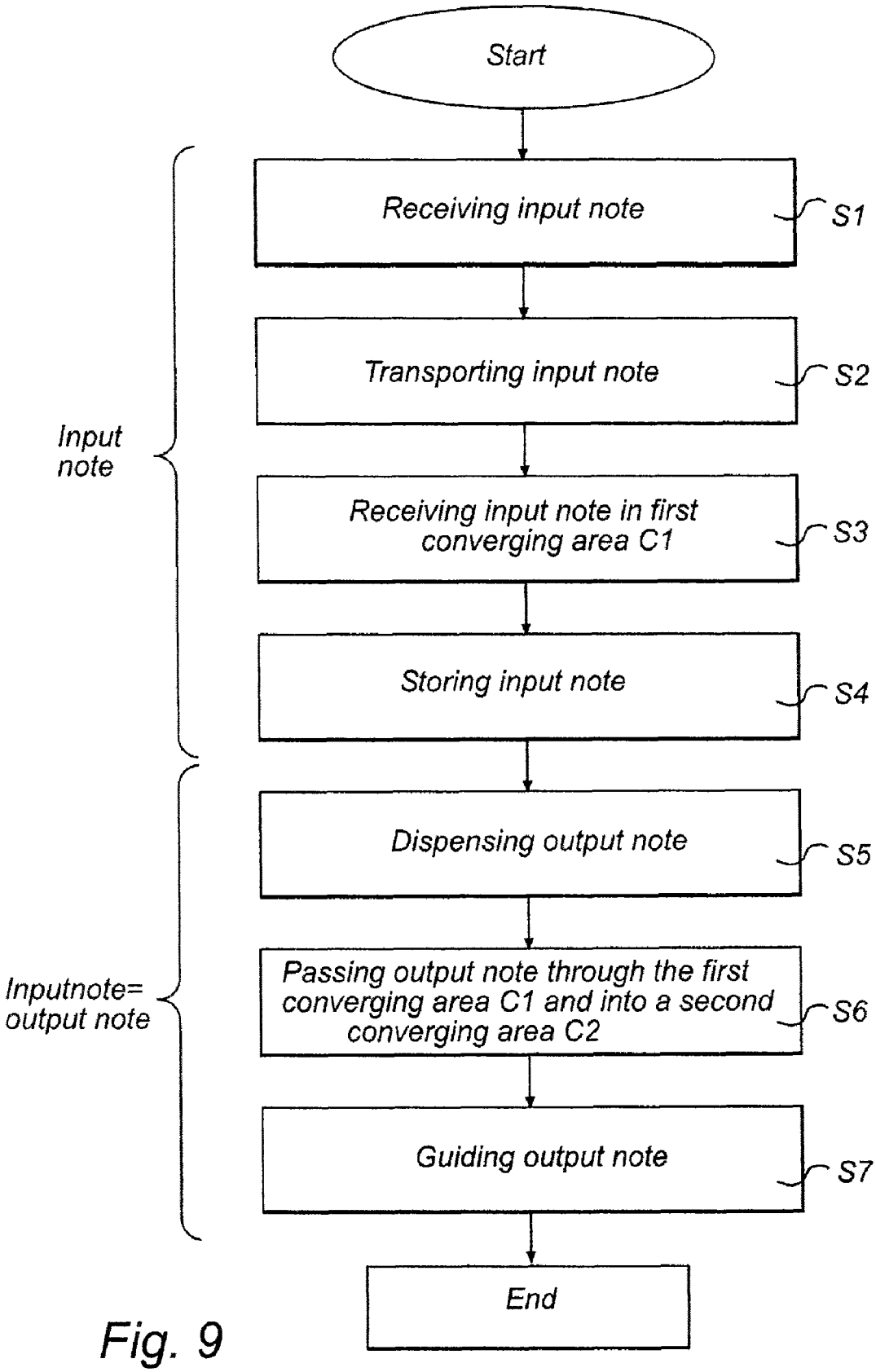
FIG. 9 is a flow chart illustrating different note handling steps in a method for bidirectional transfer of notes between a note transport unit and a note handling unit.

FIG. 9 is a flow chart of a method for bidirectional transfer of notes between the note transport unit of FIG. 1 and a note handling unit.

During Infeed

In a step S1, a note transport unit receives an input note from the note handling unit. The input note is received at a first guide surface of the note transport unit.

In a step S2, the input note is transported along the first guide surface by means of a bidirectional roller rotating in a first direction.

In a step S3, the input note is received in a first converging area (C1), formed between upper and lower film portions and converging in a note infeed direction. The upper and lower film portions form part of first and second films, respectively. The first and second film portions can be spoolable from respective film drums onto a note storage drum.

In a step S4, the input note is stored on a note storage drum between the first and the second films.

During Outfeed

In a step S5, an output note, which has previously been an input note received and stored on the note storage drum, is dispensed from the note storage drum.

In step S6, the output note is passed through the first converging area (C1) (now diverging in the outfeed direction) into a second converging area (C2). The second converging area is formed between the bidirectional roller and a second guide surface. The second converging area converges in a note outfeed direction.

In a step S7, the output note is guided towards the first guide surface by the bidirectional roller rotating in a second direction.

The person skilled in the art realizes that the present invention by no means is limited to the preferred embodiments described above. On the contrary, many modifications and variations are possible within the scope of the appended claims.

The invention claimed is:

1. A note transport unit for feeding notes one after the other to and from a note handling unit, the note transport unit having an infeed direction for input notes and an outfeed direction for output notes, wherein the note transport unit comprises:

at least one note storage drum on which the input notes are stored by being spooled around the drum between first and second films and from which the output notes are being spooled of, the first and second films presenting a lower and an upper film portion, respectively, which film portions converge towards each other in the infeed direction, a first note guide surface for guiding the input notes from the note handling unit towards the converging film portions and for guiding the output notes towards the note handling unit, a bidirectional roller arranged to transport the input notes and the output notes along the first note guide surface, and a second note guide surface which is arranged between the first note guide surface and the lower film portion and which is intersected by a plane defined by the lower film portion.

2. The note transport unit as claimed in claim 1, wherein the second guide surface is intersected by the plane with an obtuse angle.

3. The note transport unit as claimed in claim 1, wherein the second guide surface is inclined downwardly relative to the first guide surface in the infeed direction.

4. The note transport unit as claimed in claim 1, wherein the bidirectional roller is arranged to direct output notes towards the first guide surface.

5. The note transport unit as claimed in claim 1, wherein the second guide surface and the bidirectional roller are so located in relation to each other that output notes guided along the second guide surface in the outfeed direction are directed towards the roller.

6. The note transport unit as claimed in claim 1, wherein the first guide surface is the first surface of the transport unit which receives input notes from the note handling unit.

7. The note transport unit as claimed in claim 1, wherein the first guide surface is inclined upwardly in the infeed direction.

8. The note transport unit as claimed in claim 1, wherein the first guide surface is provided with a protruding portion for bending the notes perpendicularly to the transport direction of the notes when transported along the first guide surface.

9. The note transport unit as claimed in claim 8, wherein the height of the protruding portion relative to the first guide surface increases in the infeed direction.

10. The note transport unit as claimed in claim 1, wherein the first guide surface and the second guide surface form a continuous guide surface.

11. The note transport unit as claimed in claim 10, comprising a ramp body forming the first guide surface and the second guide surface.

12. The note transport unit as claimed in claim 11, wherein the ramp body is supported by a spring mechanism.

13. A method in a note transport unit for bidirectional transfer of notes one after the other between the note transport unit and a note handling unit, the transport unit having a note infeed direction for input notes and a note outfeed direction for output notes, the method comprising:

a) when handling an input note:

receiving at a first guide surface of the transport unit the input note from the note handling unit, transporting the input note along the first guide surface by means of a bidirectional roller rotating in an first direction, receiving the input note in a first converging area which is formed between upper and lower film portions and which converges in the note infeed direction, the upper and lower film portions forming part of first and second films, respectively, and storing the input note on a note storage drum between the first and second films; and b) when subsequently handling said input note as an output note:

dispensing the output note from note storage drum, passing the note through the first converging area and into a second converging area which is formed between the bidirectional roller and a second guide surface and which converges in the note outfeed direction, and guiding the note towards the first guide surface by the bidirectional roller rotating in a second direction.

* * * * *